US009211998B2

(12) United States Patent
Buskermolen et al.

(10) Patent No.: US 9,211,998 B2
(45) Date of Patent: Dec. 15, 2015

(54) COLLAPSIBLE TRANSPORT CONTAINER, CONNECTING MEMBER AND METHOD TO FOLD A COLLAPSIBLE TRANSPORT CONTAINER

(75) Inventors: Robert Anthonius Buskermolen, Amsterdam (NL); Arthur Vincent Marius Meijers, Rotterdam (NL)

(73) Assignee: Holland Container Innovations B.V. (NL)

( * ) Notice: Subject to any disclaimer, the term of this patent is extended or adjusted under 35 U.S.C. 154(b) by 99 days.

(21) Appl. No.: 14/116,381

(22) PCT Filed: Apr. 26, 2012

(86) PCT No.: PCT/NL2012/050280

§ 371 (c)(1),
(2), (4) Date: Mar. 12, 2014

(87) PCT Pub. No.: WO2012/154036

PCT Pub. Date: Nov. 15, 2012

(65) Prior Publication Data

US 2014/0183186 A1 Jul. 3, 2014

(30) Foreign Application Priority Data

May 10, 2011 (NL) ..... 2006748

(51) Int. Cl.
*B65D 88/52* (2006.01)
*B65D 6/18* (2006.01)

(52) U.S. Cl.
CPC ..... *B65D 88/52* (2013.01); *B65D 88/522* (2013.01); *B65D 11/1833* (2013.01); *B65D 88/524* (2013.01)

(58) Field of Classification Search
CPC .. B65D 88/522; B65D 88/52; B65D 11/1833; B65D 11/82; B65D 88/524
USPC ..... 220/1.5, 6, 666
See application file for complete search history.

(56) References Cited

U.S. PATENT DOCUMENTS

| | | | | |
|---|---|---|---|---|
| 3,752,349 | A | 8/1973 | Rana | |
| 5,761,854 | A * | 6/1998 | Johnson et al. | 52/69 |
| 8,251,250 | B1 * | 8/2012 | Simmons et al. | 220/810 |

FOREIGN PATENT DOCUMENTS

| | | | |
|---|---|---|---|
| DE | 33 17 221 | A1 | 11/1984 |
| DE | 3805981 | A1 | 9/1989 |

(Continued)

OTHER PUBLICATIONS

PCT/NL2012/050280 International Search Report dated Nov. 15, 2012.

(Continued)

*Primary Examiner* — Stephen Castellano
(74) *Attorney, Agent, or Firm* — Edmonds & Nolte, PC

(57) ABSTRACT

A collapsible transport container (302) comprising a base (304), a roof (310), a first and second opposed side wall (308, 306) rotatable relative to the base (304) and the roof (310). Also provided with first connecting member (316) operably connecting the first side wall (306) to the roof and second connecting member (318) operably connecting the second side wall (306) to the roof (310). The distance between the point of attachment of first and second connecting member (318, 316) to the roof (310) is less than the distance between the point of attachment (326, 324) of first and second connecting member 326, 324) to the first and second side wall (308, 306). At least part of the connecting member is flexible.

17 Claims, 7 Drawing Sheets

(56) References Cited

FOREIGN PATENT DOCUMENTS

| | | | |
|---|---|---|---|
| DE | 102 32 261 | A1 | 2/2003 |
| DE | 20320857 | U1 | 3/2005 |
| DE | 20 2006 006758 | U1 | 9/2007 |
| FR | 2130226 | A1 | 11/1972 |
| NL | 1 017 159 | C2 | 7/2002 |
| WO | 2008/131886 | A2 | 11/2008 |
| WO | 2009/038518 | A1 | 3/2009 |
| WO | 2010/151116 | A1 | 12/2010 |
| WO | 2012/154036 | A1 | 11/2012 |

OTHER PUBLICATIONS

NL Search Report and Written Opinion dated Feb. 28, 2012 (6 Pages).

* cited by examiner

COLLAPSIBLE TRANSPORT CONTAINER, CONNECTING MEMBER AND METHOD TO FOLD A COLLAPSIBLE TRANSPORT CONTAINER

This application is a United States national phase application of co-pending International Application Number PCT/NL2012/050280, filed Apr. 26, 2012, which claims priority to Dutch patent application number 2006748, filed May 10, 2011, in the Netherlands Patent Office, the disclosures of which are incorporated herein by reference to the extent consistent with the present disclosure.

This invention relates to a collapsible transport container having an improved connecting mechanism between the walls and roof of the container, and to a connecting member for such a container.

BACKGROUND

This invention relates to containers of the kind used for the transport of freight in so-called 'container-ships', or by rail or by road. Such containers are made to one of a few internationally agreed sizes. Global trade and distribution imbalances frequently necessitate the transport of empty containers from large consumption markets to regions of mass production and manufacture. In order to alleviate the cost of transporting empty containers, collapsible containers have been developed. These containers can be folded when empty into a collapsed or stowed condition in which they occupy significantly less volume than in their assembled or erected condition, thus allowing for more efficient transportation of the containers when empty.

NL1017159, U.S. Pat. No. 4,099,640 and WO-A-2010/151116 describe examples of collapsible goods-shipping containers.

Assembly and disassembly of collapsible containers must take place in a safe and reliable manner. Frequently, the size and weight of the container walls are such that heavy lifting equipment such as forklifts must be employed, complicating operation and increasing the burden of assembly/disassembly. It is therefore desirable to simplify as far as possible the procedure for assembly and disassembly of collapsible containers. One known type of collapsible container 102 is illustrated in FIGS. 1*a* and 1*b* and comprises a base 104, side walls 106, 108 and a roof 110. The walls 106, 108 are hinged to the base 104 at hinges 112, 114 such that they may rotate about the hinges and fold onto the base 104. The roof 110 is connected to the opposed side walls 106, 108 via rigid connection members 116, 118, each of which is connected via a first hinge 124, 126 to a respective side wall 106, 108 and via a second hinge 120, 122 to the roof 110. The connection members may thus pivot about each end, allowing for raising of the roof 110, pivoting motion of the walls 106, 108 beneath the roof 110 and then lowering of the roof 110 onto the collapsed walls 106, 108, as illustrated particularly in FIG. 1*b*. The connection members allow a connection to be maintained between the side walls 106, 108 and the roof 110, during the process of collapsing the walls.

It will be appreciated that, during collapsing of the walls 106, 108, the connection members 116, 118 pass through an angle approaching 270° with respect to the walls 106, 108. In order to allow for this range of motion, it is necessary to leave considerable clearance around the walls, and this need for clearance impacts on the connectivity between the walls and the roof. In practice, it is extremely difficult to establish a seal between the roof 110 and walls 106, 108, while leaving the necessary clearance, and consequently, the container 102 cannot be made watertight. This is a considerable disadvantage.

Another known container type that seeks to address the issue of sealing between the roof and walls of the container is illustrated in FIGS. 2*a* and 2*b*. This container 202 also comprises a base 204, opposed side walls 206, 208 and a roof 210. The walls 206, 208 are hinged to the base 204 at hinges 212, 214 such that they may rotate about the hinges and fold onto the base 204. The roof 210 is connected to the opposed side walls 206, 208 via rigid connection members 216, 218. Each connection member comprises a first end which is connected via a first hinge 224, 226 to a respective side wall 206, 208. The second ends of the connection members 216, 218 are formed as runners 230, 232, adapted to be slidably received within a respective slot or channel 234, 236 formed on the roof 210. According to this construction, it is possible to lift the roof 210, pivot the side walls 206, 208 towards the base 204 and subsequently lower the roof 210 without the need for excessive pivoting of the connection members 216, 218. The connection members merely slide within the slots 264, 236 formed within the roof 210. Owing to this sliding motion, the container can be constructed without the need for large clearance between the walls 206, 208 and the roof 210, and a watertight seal may be obtained between the walls 206, 208 and the roof 210. A further example of a collapsible container of this type is disclosed in FR-A-2699513.

Although the container of FIG. 2 addresses the clearance and sealing issues experienced with the container of FIG. 1, other issues of assembly and disassembly are known to arise with this type of container. In order to accommodate the motion required for assembly, the slot and slider system must be relatively complex. In addition, it is necessary to maintain the roof in accurate alignment with the base during assembly and disassembly of the container. Misalignment of the roof with respect to the rest of the container can cause the slider mechanisms to jam during motion, placing excessive forces on the slider joints. In practice, it is extremely difficult to maintain accurate alignment of the roof when lifting, for example with a reach stacker or a crane. The connection members, sliders and hinges must therefore be highly robust to withstand the large loads experienced during assembly and disassembly of the container. Even with extremely robust connections, a trained operator is required and there remains a risk that the connections between the connection members and the roof or the walls will fail.

This invention seeks to address some or all of the above mentioned disadvantages associated with known collapsible transport containers.

SUMMARY OF THE INVENTION

According to the present invention, there is provided a collapsible transport container comprising:

- a base;
- a roof;
- a first and second opposed side wall rotatable relative to the base and the roof and
- first connecting member operably connecting the first side wall to the roof and second connecting member operably connecting the second side wall to the roof, wherein the distance between the point of attachment of first and second connecting member to the roof is less than the distance between the point of attachment of first and second connecting member to the first and second side wall and wherein at least part of the connecting member is flexible.

The roof may be lifted from the side walls.

The connecting member may connect to the roof at a fixed location.

The connecting member may connect to the roof via a hinge to allow for pivotal motion between the connecting member and the roof.

The connecting member may connect to the wall at a fixed location which may for example be a hinged connection.

The connecting member may connect to the roof via a sliding connection.

The sliding connection may be formed by a carriage to which the connecting member is attached and which is slidably received within a rail formed on the roof. The carriage may be integrally formed with the connecting member or may be a separate component. The sliding connection may incorporate any appropriate mechanism allowing for sliding motion of the connecting member with respect to the roof, the sliding connection may for example be formed by a wheel formed on an end of the connecting member and received within an appropriate rail formed on the roof.

The rail may for example comprise a slot or channel formed within the roof, or may be a separate component attached to the roof. The carriage may be formed as a slider or other sliding connection and may engage with the rail in any appropriate sliding manner, for example being received within the confines of the rail or extending either side of the rail with a bifurcated formation.

The connecting member may be connected to the carriage via a hinge.

The collapsible container may further comprise a biasing element which may be formed within the rail and may be operable to bias the carriage to a stowed position.

The stowed poison of the carriage may be towards a central region of the rail.

The biasing element may comprise a return spring.

The connecting member may comprise a rigid portion and a flexible portion.

The flexible portion may be resilient and may for example be elastic.

An end of the rigid portion may be operably connected to the roof and an end of the flexible portion may be operably connected to the wall.

The rigid portion of the connecting member may comprise a rigid rod which may for example be hollow. The rod may for example comprise a beam, tube or any other appropriate structure.

The flexible portion of the connecting member may comprise one of a cable, rope, chain or strap.

A connection between the rigid portion and the flexible portion of the connecting member may be a fixed connection.

Alternatively, a connection between the rigid portion and the flexible portion of the connecting member may be a sliding connection.

An end of the flexible portion of the connecting member may be slidably received within the rigid portion of the connecting member.

The connecting member may further comprise a biasing element, which may be operable to bias the flexible portion of the connecting member towards the rigid portion of the connecting member. The biasing element may be configured to bias the flexible portion to retract within the rigid portion.

The biasing element may be housed within the rigid portion of the connecting member and may for example comprise a spring.

The spring may be arranged in compression, such that the flexible portion extends through the spring and the spring engages against an open end of the rigid portion. In this arrangement, increasing separation between the flexible and rigid portions places the spring under compression. Alternatively, the spring may be arranged in tension, being connected to a closed end of the rigid portion such that increasing separation between the flexible and rigid portions places the spring in tension.

According to another embodiment of the invention, the connecting member may be fully flexible.

According to another aspect of the present invention, there is provided a connecting member for a collapsible transport container, the connecting member comprising a rigid portion and a flexible portion, the rigid and flexible portions being operably connected.

The rigid portion may be at least partially hollow, and an end of the flexible portion may be received within the hollow rigid portion.

The connecting member may further comprise a biasing element, which may be operable to bias the flexible portion to retract into the hollow rigid portion. The biasing element may for example comprise a spring.

The invention is also directed to a method to fold a collapsible transport container comprising:

a base;

a roof;

a first and second opposed side wall rotatable relative to the base and the roof and first connecting member operably connecting the first side wall to the roof and second connecting member operably connecting the second side wall to the roof, wherein the distance between the point of attachment of first and second connecting member to the roof is less than the distance between the point of attachment of first and second connecting member to the first and second side wall and wherein at least part of the connecting member is flexible, by lifting the roof from the first and second opposed side wall, wherein the side walls will pivot towards the base and subsequently lowering the roof, wherein the side walls will further pivot towards the base.

Preferably the method is applied to a collapsible container according to the invention.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION OF EMBODIMENTS

Figure 1A:
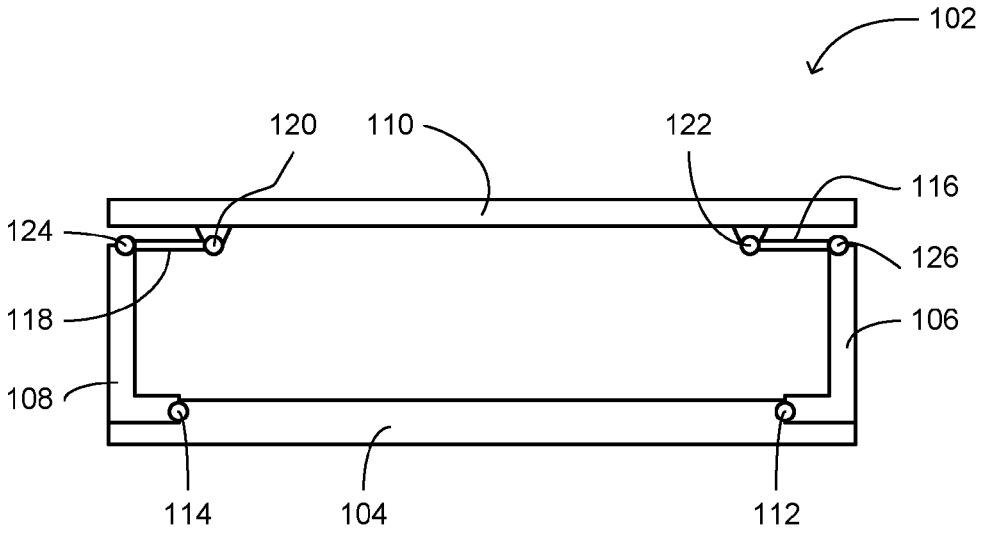
Fig. 1a (Prior Art)
FIGS. 1*a* and 1*b* illustrate a collapsible container according to the prior art.
Figure 1B:
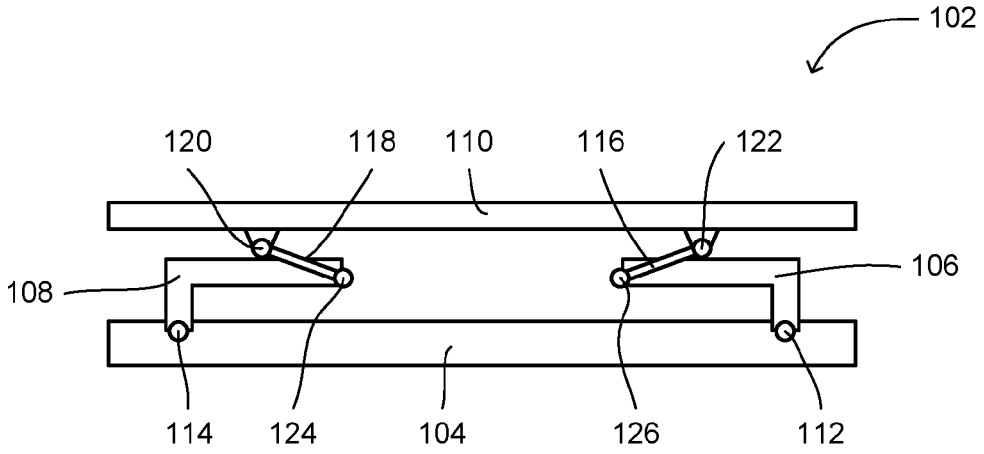
Fig. 1b (Prior Art)
Figure 2A:
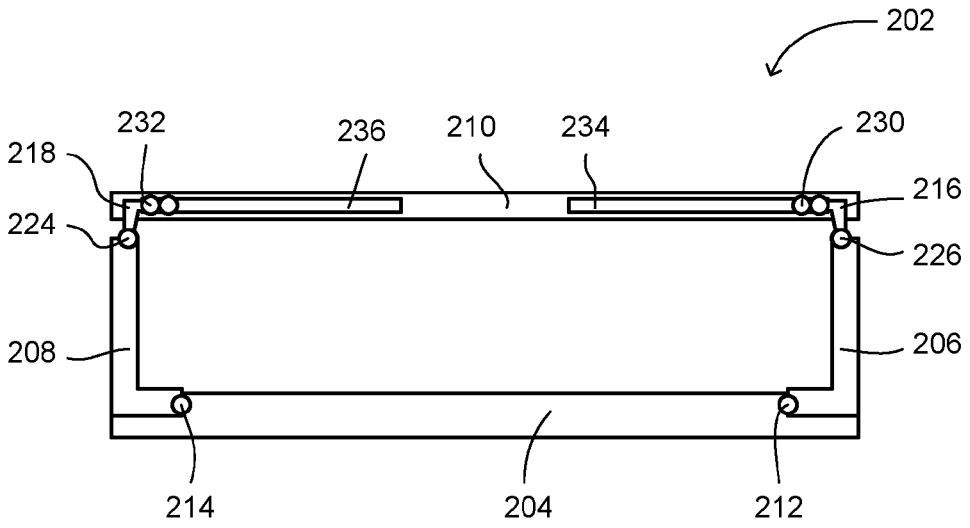
Fig. 2a (Prior Art)
FIGS. 2*a* and 2*b* illustrate another collapsible container according to the prior art.
Figure 2B:
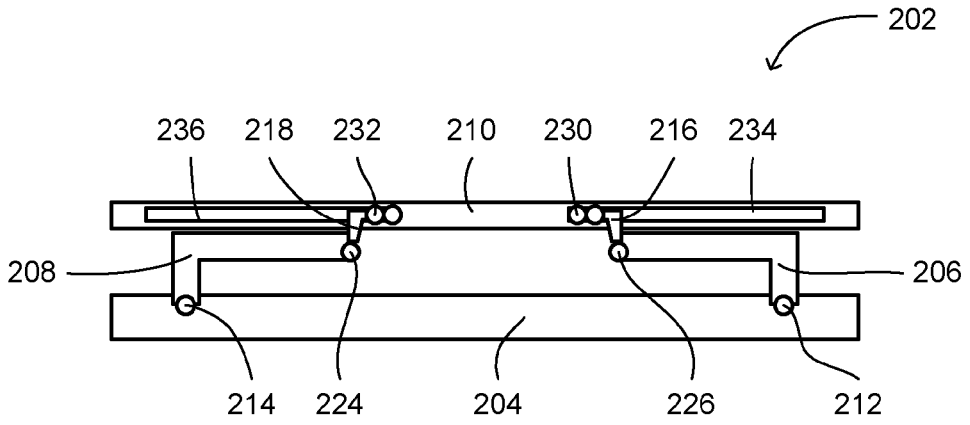
Fig. 2b (Prior Art)
Figure 3A:
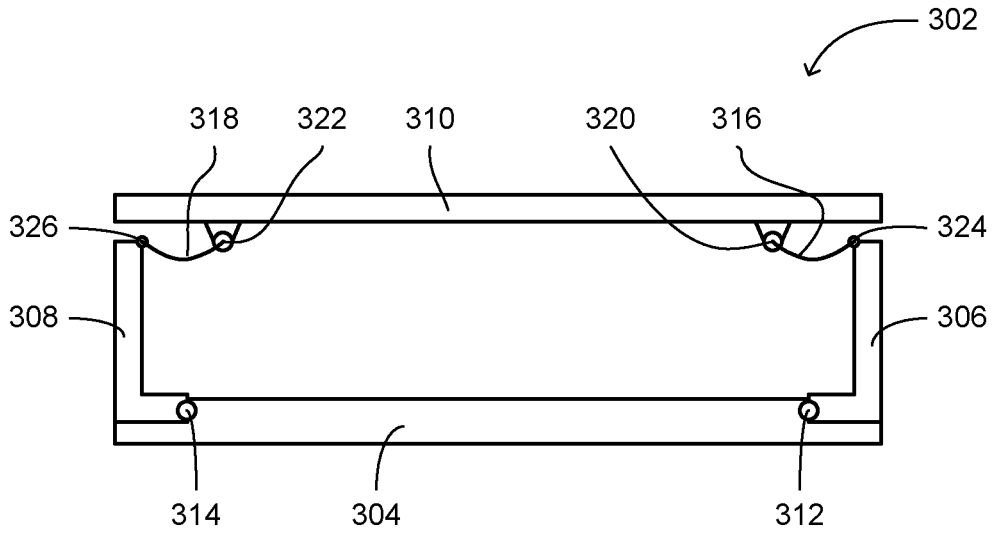
FIGS. 3*a* and 3*b* illustrate a collapsible container having flexible connecting members.
Figure 3B:
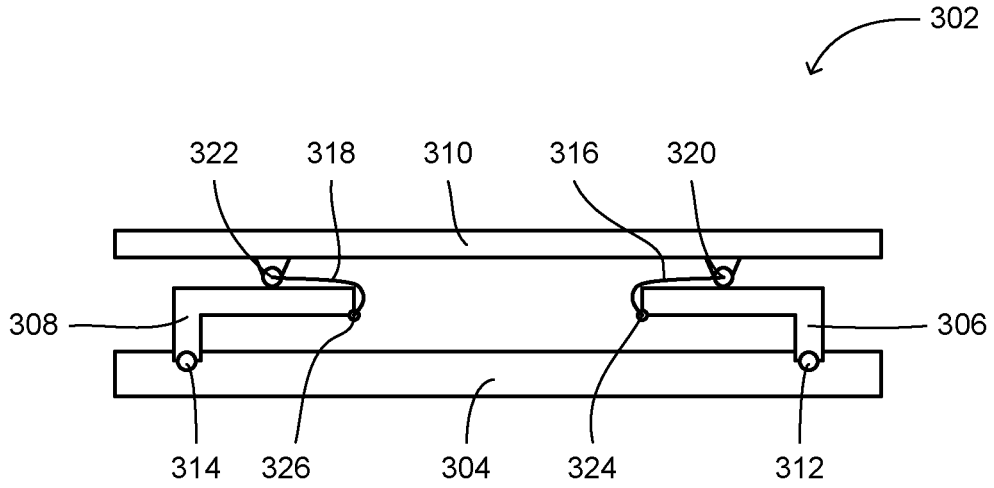

With reference to FIGS. 3*a* and 3*b*, a collapsible container 302 comprises a base 304, side walls 306, 308 and a roof 310.

The walls 306, 308 are hinged to the base 304 at hinges 312, 314 such that they may rotate about the hinges and fold onto the base 304. The hinges 312, 314 thus define axes of rotation for the walls 306, 308, these axes of rotation being substantially adjacent to the base 304. The walls 306, 308 may have an L shaped cross section, as shown in the Figures, the hinged connection being formed at a free end of the base of the L shaped wall, as illustrated. Alternatively, the walls may have a simple linear cross section. The roof 310 is connected to the opposed side walls 306, 308 via flexible connecting members 316, 318, each of which is connected via a first hinge 324, 326 to a respective side wall 306, 308 and via a second hinge 320, 322 to the roof 310 at a fixed location.

FIG. 3*a* shows that the distance between the point of attachment of first and second connecting member 318, 316 to the roof 310, i.e. the distance between second hinges 322 and 320 is less than the distance between the point of attachment of first and second connecting member 318, 316 to the first and second side wall 308, 306, i.e. the distance between hinges 326 and 324. Because of this difference in distance the side walls 306, 308 will pivot towards the base 304 when the roof 310 is lifted from the side walls 308, 306. When the side walls 308, 306 are sufficiently inclined inwards the roof 310 is subsequently lowered and the side walls 308, 306 pivot further towards the base 304 to eventually rest upon the base 304 or on any remaining side walls. The roof 310 is subsequently lowered onto the collapsed walls as illustrated in FIG. 3*b*. Containers may also have two, suitable more elongated, remaining side walls not shown in the Figures having a plane equal to the plane of FIG. 3*a*. It is preferred to first lower these two remaining side walls onto the base 304 and then pivot side walls 308, 306 towards the base 304 as explained above. In such a situation it is clear that side walls 308, 306 rest on the collapsed remaining side walls. An example of how the container of FIG. 3*a* having two remaining side walls may be collapsed into the position illustrated in FIG. 3*b* is described in NL-A-1017159.

The flexible connecting members are formed from any appropriate material including for example metallic chain, a synthetic rope or a strap or webbing material. In use, the roof 310 is lifted from the walls 306, 308 to allow the walls to be pivoted about the hinges 312, 314 and the roof is then lowered onto the collapsed walls as illustrated in FIG. 3*b*. It will be appreciated that with the flexible connecting members 316, 318, the excessive clearance of the prior art design is not required, as the flexible connecting members 316, 318 can bend and fold around the pivoting walls 306, 308. It is therefore only necessary to lift the roof 310 slightly in order to release the walls 306, 308 to pivot, rather than allowing for the large pivoting movement of the rigid connection members of the prior art. It is a further advantage that, in the assembled condition, the flexible connecting members 316, 318 may bend to be accommodated within the available space, and need not interfere with proper sealing between the walls 306, 308 and roof. The container 302 may therefore be made watertight.

Figure 4A:
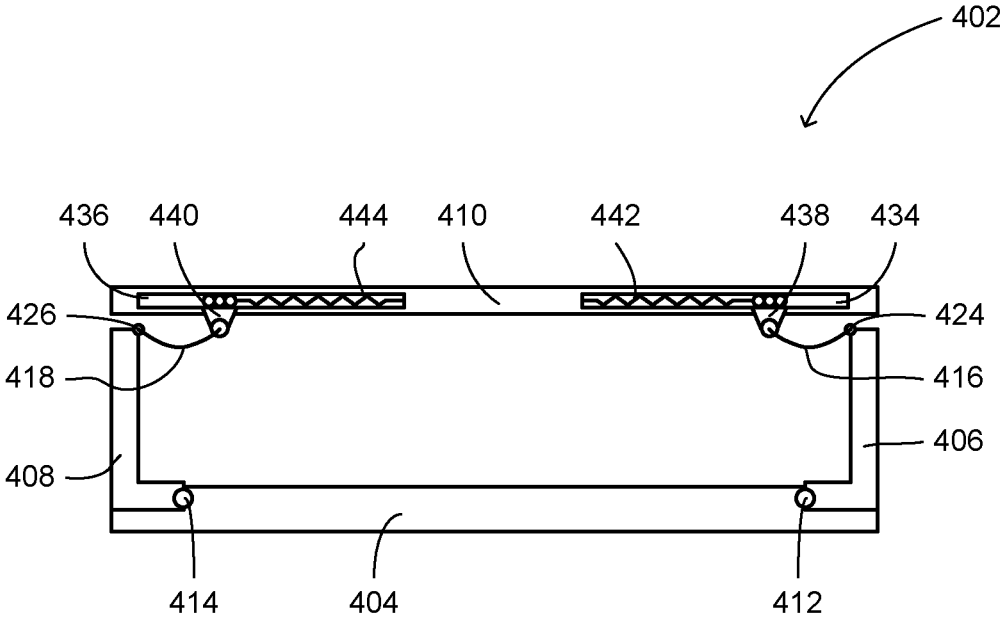
FIGS. 4*a* and 4*b* illustrate another embodiment of collapsible container having flexible connecting members.
Figure 4B:
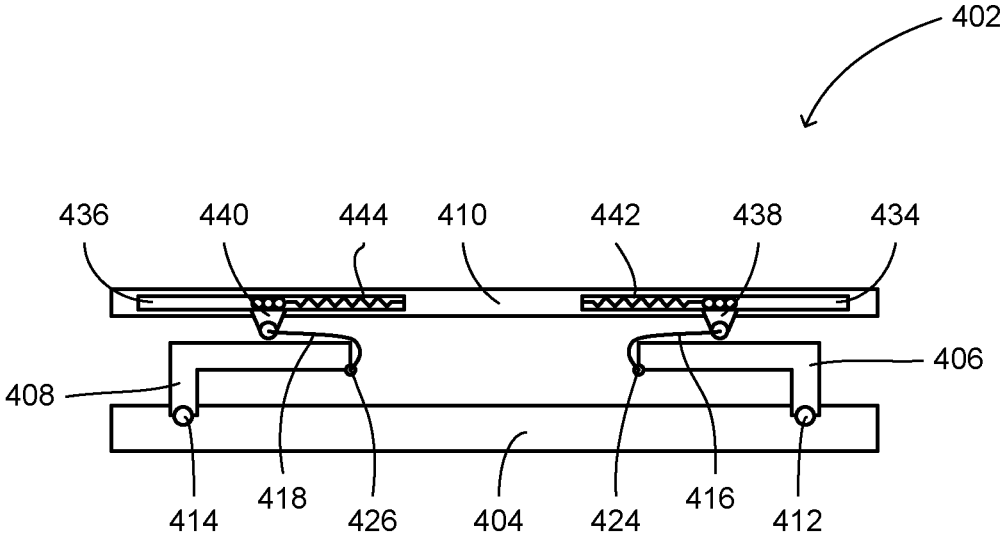

With reference to FIGS. 4*a* and 4*b*, another embodiment of collapsible container 402 comprises a base 404, opposed side walls 406, 408 and a roof 410. The walls 406, 408 are hinged to the base 404 at hinges 412, 414 such that they may rotate about the hinges and fold onto the base 404. The hinges 412, 414 thus define axes of rotation for the walls 406, 408, these axes of rotation being substantially adjacent to the base 404. As in the embodiment of FIG. 3, the walls 406, 408 may have a simple linear cross section or may have an L shaped cross section as shown in the Figures. The roof 410 is connected to the opposed side walls 406, 408 via flexible connecting members 416, 418. The flexible connecting members are formed from any appropriate material including for example metallic chain, a synthetic rope or a strap or webbing material. Each connecting member 416, 418 comprises a first end which is connected via a first hinge 424, 426 to a respective side wall 406, 408. The second ends of the connection members 416, 418 are connected to carriages 438, 440 adapted to be slidably received within a respective slot or channel 434, 436 formed on the roof 410. The carriages 438, 440 may be of any appropriate form suitable for sliding engagement with a slot or rail. For example, the carriages may be received within the corresponding slot or channel, or may comprise a bifurcated formation and may be configured to extend either side of a protruding rail. Similarly, the slots, rails or channels 434, 436 may be of any suitable form. For example, appropriate slots or channels may be formed in the material of the roof 410, or rails may be affixed to the roof 410 for engagement with the carriages 438, 440. According to one embodiment, biasing springs 442, 444 may be housed within or adjacent the rails 434, 436 to bias the carriages 438, 440 to a neutral or stowed position. The stowed position is a position towards a central region of the respective rail 434, 436. The biasing springs 442, 444 have the desirable effect of ensuring that the flexible connecting members do not hang too far inside the container in either the assembled or the collapsed condition. It will be appreciated that it is desirable for the flexible connecting members 416, 418 to be held along the roof 410 and out of the way of the container components or contents as much as possible. By biasing the carriages 438, 440 to a neutral position in the centre of the rails 434, 436, it is ensured that the flexible connecting members 416, 418 do not hang slack in either the assembled condition (for example should the carriages 438, 440 be at the outer extent of the rails 434, 436) or in the collapsed condition (for example should the carriages 438, 440 be at the inner extent of the rails, 434, 436). The biasing springs 442, 444 may thus operate in both compression and extension to ensure the carriages 438, 440 remain towards a neutral position when at rest, regardless of the state of assembly of the container 402.

The flexible connecting members 416, 418 allow for considerable misalignment between the roof 410 and the rest of the container 402 without causing undesirable stresses in the connecting members 416, 418 or their connections to the walls 406, 408 or roof 410. Jamming of the sliding joints is also avoided. The container 402 is thus simpler to assemble and disassemble than those of the prior art, as it does not require accurate alignment of the roof 410 during assembly or disassembly. In addition, the hinges or other connections between the connecting members 416, 418 and the walls 406, 408 and roof 410 may be made less robust, as they do not need to withstand large jamming forces.

Figure 5A:
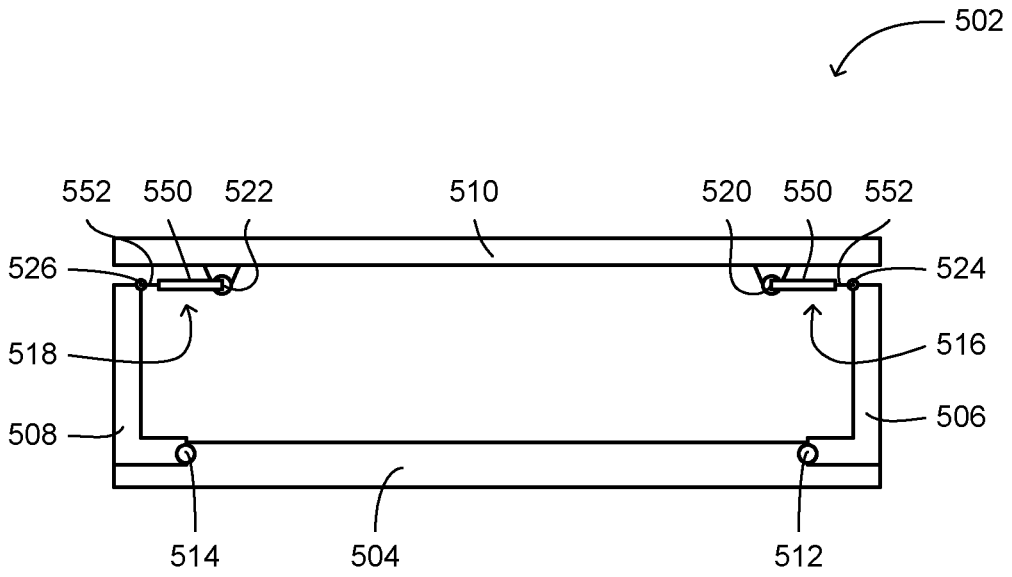
FIGS. 5*a* and 5*b* illustrate a collapsible container having partially flexible connecting members.
Figure 5B:
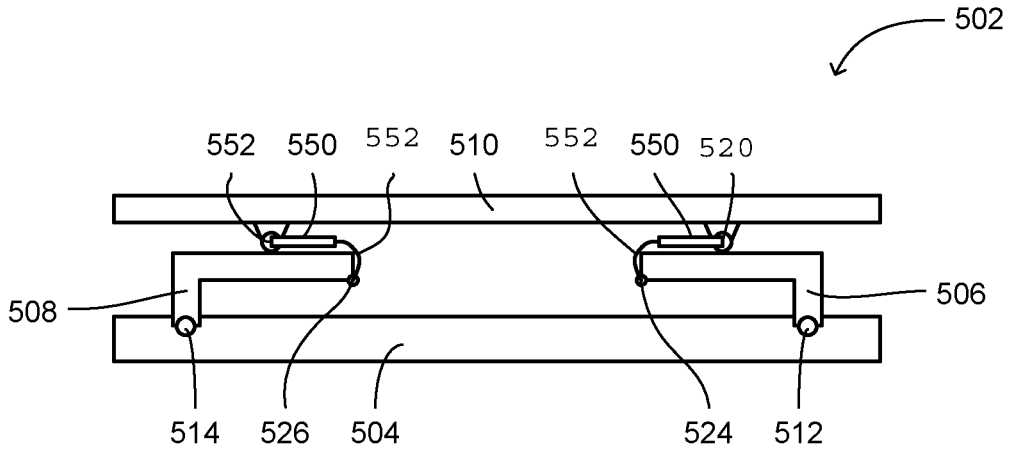

With reference to FIGS. 5*a* and 5*b*, another embodiment of collapsible container 502 comprises a base 504, side walls 506, 508 and a roof 510. The walls 506, 508 are hinged to the base 504 at hinges 512, 514 such that they may rotate about the hinges and fold onto the base 504. The hinges 512, 514 thus define axes of rotation for the walls 506, 508, these axes of rotation being substantially adjacent to the base 304. As in the embodiment of FIG. 3, the walls 506, 508 may have a simple linear cross section or may have an L shaped cross section as shown in the Figures. The roof 510 is connected to the opposed side walls 506, 508 via partially flexible connecting members 516, 518, each of which is connected via a first hinge 524, 526 to a respective side wall 506, 508 and via a second hinge 520, 522 to the roof 510. The partially flexible connecting members are formed from a rigid portion 550 and a flexible portion 552. The rigid portion comprises a rod 550, which may be hollow, and the flexible portion comprises a chain, rope or strap 552. The rigid and flexible portions 550, 552 of the connecting members 516, 518 may be fixedly or slidingly connected, as described in further detail below with reference to FIGS. 7 and 8. The rigid portions 550 are connected at the second hinges 520, 522 to the roof 510 and the flexible portions 552 are connected at the first hinges 524, 526 to the walls 506, 508, allowing the flexible portions 552 to fold and wrap around the walls during disassembly.

The partially flexible connecting members 516, 518 offer a combination of advantages owing to the combination of flexible and rigid behaviour. The flexible part 552 of the connecting members 516, 518 folds and bends, allowing for misalignment of the roof 510 during assembly and disassembly without causing strain on the connections with the walls 506, 508 and roof 510. In addition, excess clearance around the connecting members 516, 518 is not required, meaning the roof 510 can be correctly sealed to the walls 506, 508 in the assembled condition. The rigid part 550 of the connecting members helps to ensure that the connecting members do not hang down inside the container 502 in the assembled condition.

Figure 6A:
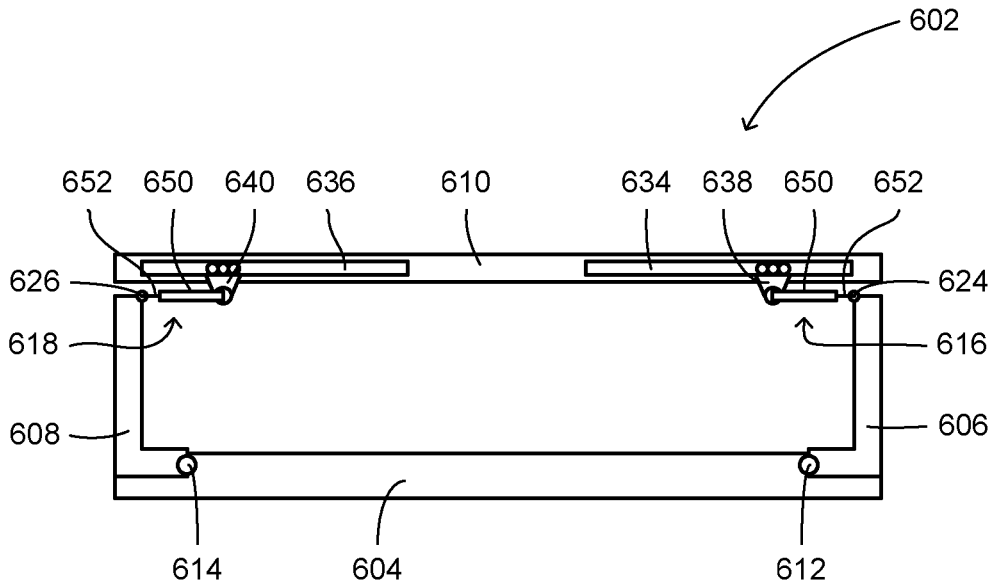
FIGS. 6*a* and 6*b* illustrate another embodiment of collapsible container having partially flexible connecting members.
Figure 6B:
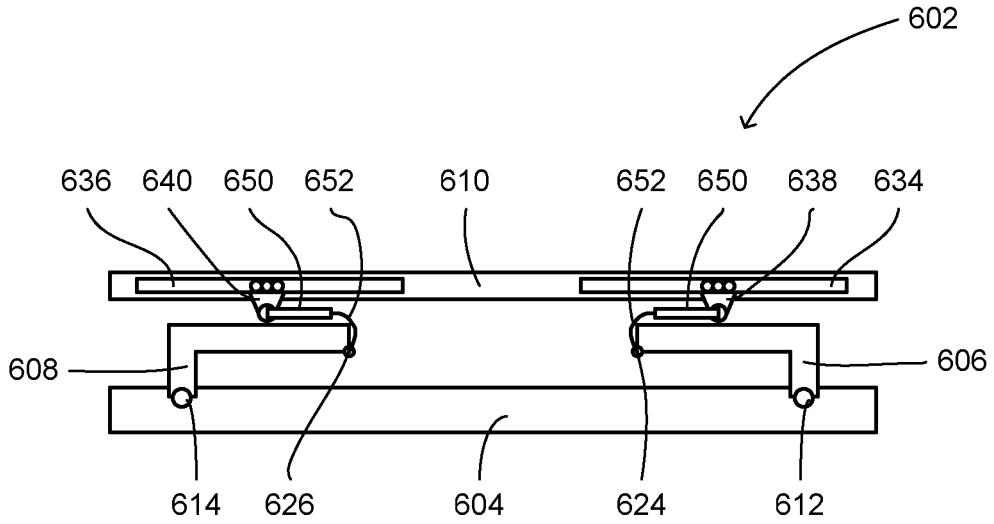

The partially flexible connecting members can also be employed in an embodiment of container having a sliding connection between the connecting members and the roof, as illustrated in FIGS. 6*a* and 6*b*. The container 602 of FIGS. 6*a* and 6*b* comprises a base 604, opposed side walls 606, 608 and a roof 610. The walls 606, 608 are hinged to the base 604 at hinges 612, 614 such that they may rotate about the hinges and fold onto the base 604. The hinges 612, 614 thus define axes of rotation for the walls 606, 608, these axes of rotation being substantially adjacent to the base 604. As in the embodiment of FIG. 3, the walls 606, 608 may have a simple linear cross section or may have an L shaped cross section as shown in the Figures. The roof 610 is connected to the opposed side walls 606, 608 via partially flexible connecting members 616, 618. The partially flexible connecting members 616, 618 comprise a rigid portion 650, which may be a hollow rod, and a flexible portion 652, which may be a chain, rope or strap. The rigid and flexible portions 650, 652 of the connecting members 616, 618 may be fixedly or slidingly connected, as described in further detail below with reference to FIGS. 7 and 8. A free end of the flexible portion 652 of each connecting member 616, 618 is connected via a first hinge 624, 626 to a respective side wall 606, 608. A free end of the rigid portion 650 of each connecting member 616, 618 is connected to a carriage 638, 640 adapted to be slidably received within a respective slot or channel 634, 636 formed on the roof 610. As in the embodiment of FIGS. 4*a* and 4*b* described above, the carriages 638, 640 may be of any appropriate form suitable for sliding engagement with a slot or rail. For example, the carriages may be received within the corresponding slot or channel, or may comprise a bifurcated formation and may be configured to extend either side of a protruding rail. Similarly, the slots, rails or channels 634, 636 may be of any suitable form. For example, appropriate slots or channels may be formed in the material of the roof 610, or rails may be affixed to the roof 610 for engagement with the carriages 638, 640.

Biasing may be included in the embodiment of FIG. 6, in order to ensure that the flexible portions 652 of the connecting members 616, 618 do not hang down inside the container 602. Biasing springs (not shown), of the type described above with respect to FIGS. 4*a* and 4*b*, may be incorporated within the rails 634, 636. Alternatively, the biasing may be incorporated into the connection members themselves, as illustrated in FIG. 8 and described below.

Figure 7:
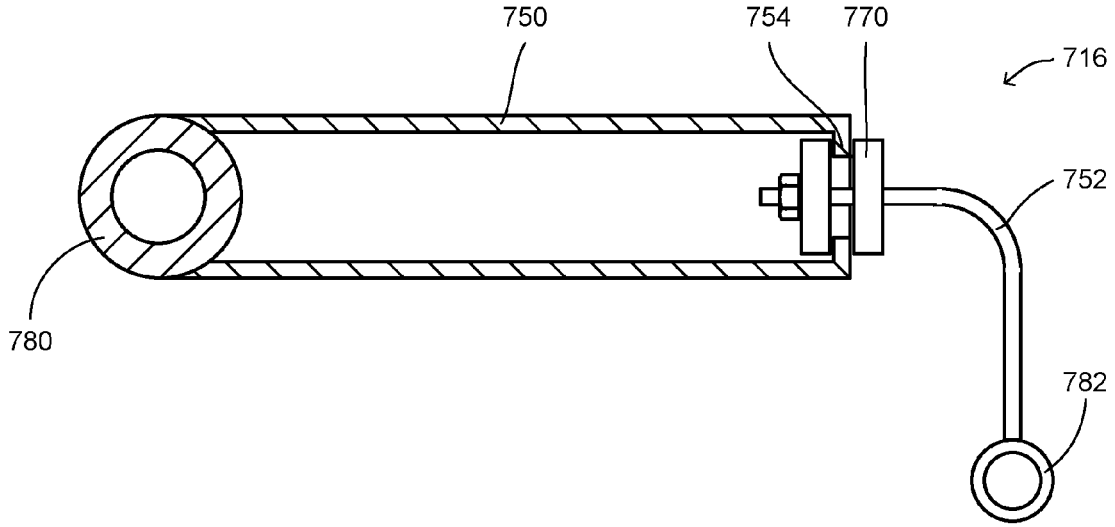
FIG. 7 illustrates a partially flexible connecting member.
Figure 8:
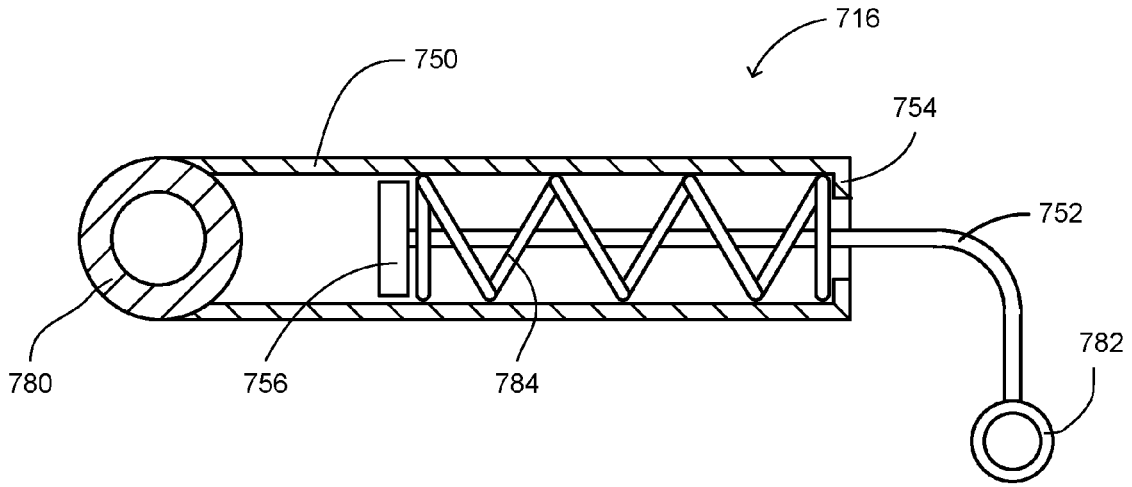
FIG. 8 illustrates another embodiment of partially flexible connecting member.

FIGS. 7 and 8 illustrate two embodiments of a partially flexible connecting member 716, which are suitable for use with any of the above described embodiments of collapsible container.

With reference to FIG. 7, a first embodiment of connecting member 716 comprises a hollow rigid rod 750 terminating at a first end in a connection 780 for engagement with a roof of a collapsible container. The connection 780 may comprise part of a hinged connection, a pin, an integrally formed carriage or any other appropriate connection. The hollow rod 750 is preferably formed from a robust metallic material such as steel. The connecting member 716 further comprises a flexible portion 752 formed from a rope, chain, strap or similar robust but flexible material. A first end of the flexible portion 752 terminates in a connection 782 for engagement with a wall of a collapsible container. As with connection 780, the connection 782 may comprise part of a hinged connection, a pin, or any other appropriate connection. The rigid and flexible portions 750, 752 are fixedly joined together by a connector 770 which engages an annular flange 754 on the second end of the rod 750 and through which the second end of the flexible portion 752 passes. The second end of the flexible portion is secured to the connector 770 by a nut, clamp or other connection mechanism having sufficient integrity to withstand the predicted in service loads.

With reference to FIG. 8, the connector 770 may be replaced with a sliding connection arrangement, such that the combined length of the connection member 716 may be varied, and may biased towards a certain length. According to this arrangement, the second end of the flexible portion 752 extends into the hollow rigid rod 750 and terminates an at engagement plate 756. A biasing spring 784 is mounted within the hollow rigid rod 750 about the flexible portion 752. The biasing spring engages at a first end upon the engagement plate 756 of the flexible portion 752 and engages at a second end on the annular flange 754 of the hollow rigid rod. The flexible portion 752 of the connecting member is thus biased to retract into the hollow rigid rod, ensuring that excess length of the flexible connecting member will not hang slack when it is not required and will be neatly stored away within the hollow rigid rod, where it cannot catch or tangle with any components or contents of the container with which it is used.

The present invention thus provides a collapsible container affording several advantages over known containers. The connections between the connecting members and the walls and roof of the container may be made simpler and less robust, as they do not need to withstand such large forces during assembly and disassembly. A large clearance around the connecting members is not required, allowing for reliable sealing between the roof and walls, and misalignment of the roof during assembly or disassembly can be accommodated without unduly stressing any of the container components.

The invention claimed is:

1. A collapsible transport container, comprising:

a base;

a roof;

a first and second opposed side wall rotatable relative to the base and the roof; and first connecting member operably connecting the first side wall to the roof and second connecting member operably connecting the second side wall to the roof, each of the first connecting member and the second connecting member comprising a rigid portion and a flexible portion, wherein the rigid portion comprises a rigid rod and the flexible portion is configured to bend along a length thereof, an end of each flexible portion operatively connected to the respective first side wall and the second side wall via a hinge, wherein the distance between the point of attachment of first and second connecting member to the roof is less than the distance between the point of attachment of first and second connecting member to the first and second side wall, and wherein a connection between the rigid portion and the flexible portion of each of the first connecting member and the second connecting member is a sliding connection.

2. A collapsible container as claimed in claim 1, wherein an end of the rigid portion is operably connected to the roof.

3. A collapsible container as claimed in claim 1, wherein the rigid rod comprises a hollow rod.

4. A collapsible container as claimed in claim 1, wherein the flexible portion comprises one of a cable, rope, chain, or strap.

5. A collapsible container as claimed in claim 1, wherein another end of the flexible portion of each of the first connecting member and the second connecting member is slidably received within the respective rigid portion of the first connecting member and the second connecting member.

6. A collapsible container as claimed in claim 1, wherein each of the first connecting member and the second connecting member further comprises a biasing element, operable to bias the flexible portion of each of the first connecting member and the second connecting member towards the respective rigid portion of the first connecting member and the second connecting member.

7. A collapsible container as claimed in claim 6, wherein the biasing element is housed within the rigid portion of each of the first connecting member and the second connecting member.

8. A collapsible container as claimed in claim 6, wherein the biasing element comprises a spring.

9. A collapsible container as claimed claim 1, wherein each of the first connecting member and the second connecting member connects to the roof at a fixed location.

10. A collapsible container as claimed in claim 1, wherein each of the first connecting member and the second connecting member connects to the roof via another hinge.

11. A collapsible container as claimed in claim 1, wherein each of the first connecting member and the second connecting member connects to the roof via a sliding connection.

12. A collapsible container as claimed in claim 11, wherein the sliding connection is formed by a carriage to which each of the first connecting member and the second connecting member is attached and which is slidably received within a rail formed on the roof.

13. A collapsible container as claimed in claim 12, wherein each of the first connecting member and the second connecting member is connected to the carriage via another hinge.

14. A collapsible container as claimed in claim 12, further comprising a biasing element formed within the rail and operable to bias the carriage to a stowed position.

15. A collapsible container as claimed in claim 14, wherein the stowed position of the carriage is towards a central region of the rail.

16. A collapsible container as claimed in claim 14, wherein the biasing element comprises a return spring.

17. Method to fold a collapsible transport container, comprising:

a base;

a roof;

a first and second opposed side wall rotatable relative to the base and the roof; and first connecting member operably connecting the first side wall to the roof and second connecting member operably connecting the second side wall to the roof, each of the first connecting member and the second connecting member comprising a rigid portion and a flexible portion, wherein the rigid portion comprises a rigid rod and the flexible portion is configured to bend along a length thereof, an end of each flexible portion operatively connected to the respective first side wall and the second side wall via a hinge, wherein the distance between the point of attachment of first and second connecting member to the roof is less than the distance between the point of attachment of first and second connecting member to the first and second side wall, and wherein a connection between the rigid portion and the flexible portion of each of the first connecting member and the second connecting member is a sliding connection, by lifting the roof from the first and second opposed side wall, wherein the side walls will pivot towards the base and subsequently lowering the roof, wherein the side walls will further pivot towards the base.

* * * * *